United States Patent [19]

Nakadai et al.

[11] Patent Number: 4,642,596

[45] Date of Patent: Feb. 10, 1987

[54] MINIATURIZED TRANSFORMER

[75] Inventors: Shigeru Nakadai; Teruo Tamada, both of Saitama, Japan

[73] Assignee: Toko, Inc., Tokyo, Japan

[21] Appl. No.: 774,738

[22] Filed: Sep. 11, 1985

[30] Foreign Application Priority Data

Sep. 11, 1984 [JP] Japan ..... 59-137760[U]
Jan. 19, 1985 [JP] Japan ..... 60-6158[U]

[51] Int. Cl.[4] ..... H01F 15/10; H01F 27/30

[52] U.S. Cl. ..... 336/98; 336/198

[58] Field of Search ..... 336/65, 92, 105, 192, 336/199, 208, 90, 98, 65, 192, 198

[56] References Cited

U.S. PATENT DOCUMENTS 4,347,490 8/1982 Peterson ..... 336/65 X
4,443,777 4/1984 Koike ..... 336/192 X

FOREIGN PATENT DOCUMENTS 2146484 3/1973 Fed. Rep. of Germany ..... 336/192

*Primary Examiner*—Thomas J. Kozma

[57] ABSTRACT

A miniaturized transformer which is constructed so that lead wires of a coil are first upwardly led out of the coil and then downwardly extended to be used as terminals for the transformer.

9 Claims, 8 Drawing Figures

MINIATURIZED TRANSFORMER

BACKGROUND OF THE INVENTION

1. Field of the Invention

This invention relates to a miniaturized electronic component device, and more particularly it pertains to a miniaturized transformer usable with a switching circuit for power supply device or the like.

2. Description of the Prior Art

In order to have a better understanding of the present invention, description will first be made of a conventional transformer of this type with reference to FIG. 1 of the accompanying drawings.

The conventional transformer shown in FIG. 1 comprises a coil 1 wound on a bobbin whose upper and lower flanges are indicated at 2 and 3 respectively; a core 4 which is fitted with the bobbin to establish a magnetic circuit; and a base plate 5 of an insulating material supporting the bobbin thereon. A plurality of terminal pins 6 are planted in the underface of the base plate 5, and a plurality of vertically extending grooves 7 are formed in a side surface of the base plate 5. Lead wires 8 of the coil 1, which are downwardly led out of the lower flange 3 and then extended through the grooves 7 of the base plate 5, are connected to the base portions of the terminal pins 6.

However, the foregoing conventional transformer has, among others, the following disadvantage: Difficulties are experienced in an attempt to reduce the height of the transformer due to the fact that the lead wires 8 of the coil 1 are led out of the flange 3 of the bobbin toward the base plate 5 and thence made to extend through the grooves 7 formed in the side surface of the base plate 5 so as to be connected to the terminal pins 6, i.e., the lead wires 8 are made to extend downwardly from the coil 1 so that the vertical length of the portion below the coil 1 is increased. Obviously, such electronic component of an increased height is not desired from the standpoint of meeting the currently prevailing demand for miniaturization of electronic components.

SUMMARY OF THE INVENTION

Accordingly, it is a primary object of the present invention to provide a miniaturized transformer of a reduced height.

Another object of the present invention is to provide a miniaturized transformer which requires no base plate or terminal pins.

Still another object of the present invention is to provide a miniaturized transformer which uses only a small number of parts and is easy to assemble.

According to an aspect of the present invention, there is provided a miniaturized transformer comprising a bobbin having a drum portion on which a coil is to be wound; and a pair of frames securely attached to the bobbin at the opposite sides thereof to accommodate the coil therein. The bobbin is provided, at least at the upper end of the drum portion thereof, with a pair of arm-like portions which extend horizontally from the opposite sides of the drum portion of the bobbin and in parallel relationship with each other. Each of the arm-like portions is provided, at the opposite ends thereof, with engagement portions adapted for engagement with the aforementioned frames. Each of the pair of frames comprises a first and a second side plate portion which are disposed in opposing relationship with each other; and a third side plate portion which is disposed substantially at right angles with respect to the first and second side plate portions and connects these portions together. Each of the first and second side plate portions is provided with means adapted for engagement with the ends of the arm-like portions of the bobbin. Lead wires of the coil are upwardly led out of the coil and then downwardly extended along the outer surfaces of the aforementioned third side plate portions so as to be used as terminals.

Other objects, features and advantages of the present invention will become apparent from the ensuing description taken in conjunction with the accompanying drawings.

DESCRIPTION OF THE PREFERRED EMBODIMENTS

Figure 3:
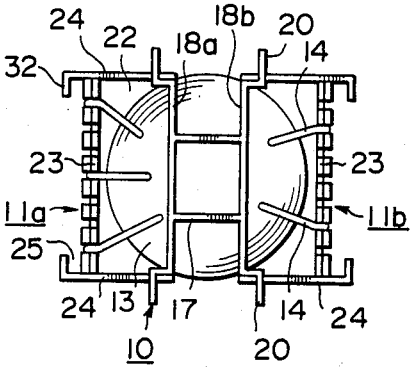
FIG. 3 is a top plan view showing the transformer of FIG. 2, with the cores and outer plates thereof being omitted.
Figure 4:
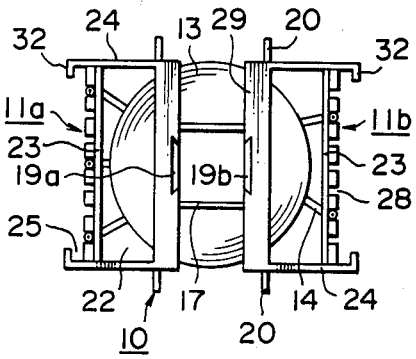
FIG. 4 is a bottom plan view showing the transformer of FIG. 2, with the cores and outer plates being omitted.
Figure 2:
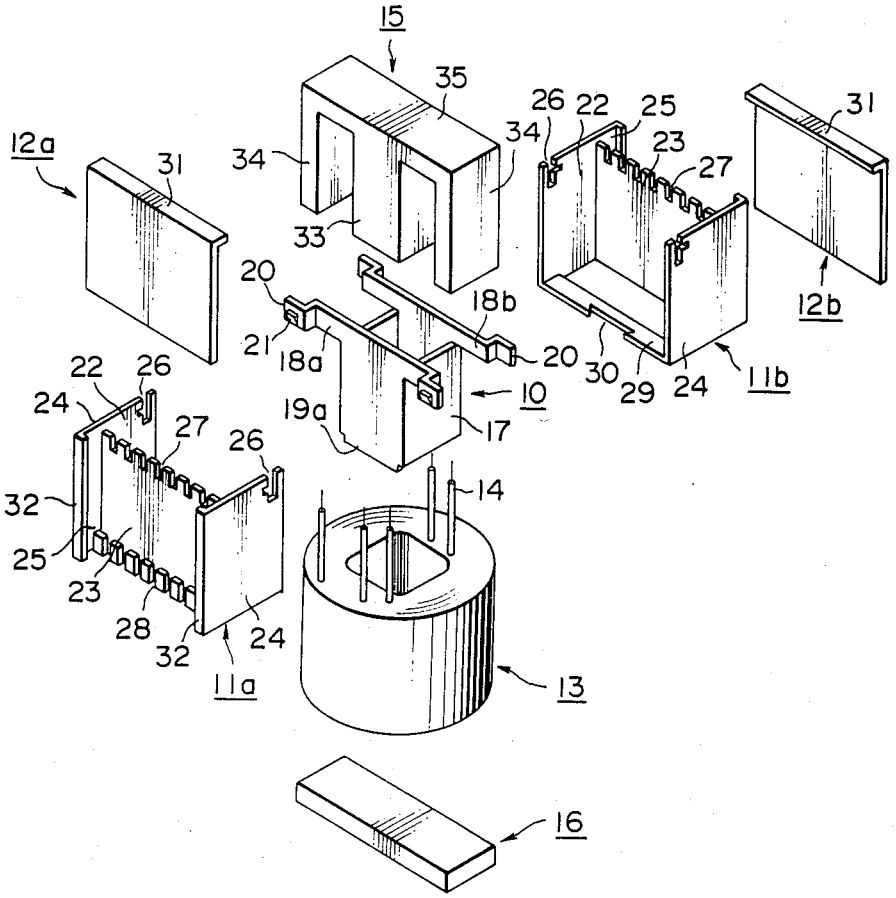
FIG. 2 is an exploded perspective view of the transformer according to an embodiment of the present invention.

Referring to FIGS. 2 to 4 of the drawings, there is illustrated a transformer embodying the present invention. FIG. 2 is an exploded perspective view of the transformer; FIG. 3 is a top plan view thereof; and FIG. 4 is a bottom plan view thereof.

The transformer comprises a bobbin 10; a pair of frames 11*a* and 11*b*; a pair of outer plates 12*a* and 12*b*; a coil 13; a plurality of lead wires 14 led upwardly out of the coil 13; an E-shaped core 15; and an I-shaped core 16.

The bobbin 10, which is made of a plastic material, has a drum portion 17 which is configured in the form of a hollow cylinder having a rectangular or square cross section. The coil 13 consists of a band-like conductor and is wound on the drum portion 17. Two opposite walls of the drum portion 17 of the bobbin 10 are provided, at their upper ends, with a pair of arm-like portions 18*a* and 18*b* respectively, and are also provided, at their lower ends, with downwardly extending skirt portions 19*a* and 19*b* respectively. Each of the arm-like portions 18*a* and 18*b* has its opposite end portions 20 bent in crank-like form as viewed in a plan view, and each of the bent end portions 20 is provided, on its outward face, with a protuberance 21. The arm-like portions 18*a* and 18*b* are also adapted to serve as flanges.

Each of the frames 11*a* and 11*b* is configured to have substantially the same height as the bobbin 10 and comprises a pair of opposite side plate portions 24, 24 and a third side plate portion 23 disposed at right angles with respect to the side plate portions 24, 24 and connecting latter together. In each of the frames, the third side plate portion 23 is connected to the side plate portions 24, 24 adjacent to the end portions remote from the bobbin 10; thus, as viewed in a plan view, each of the frames 11*a* and 11*b* takes a modified H-shaped form. The side plate portions 23 serve as separator plates to separate a coil accommodating region 22 from regions 25 where the lead wires 14 of the coil 13 are led out. Slit 26 is formed in the upper corner portion of each of the portions of the side plate portions 24 which define the coil accommodating region 22. The slits 26 are formed with laterally extending portions adapted for engagement with the protuberances 21 provided on the arm-like portions 18*a* and 18*b* respectively to securely retain the end portions 20 of the arm-like portions 18*a* and 18*b*. The coil accommodating region 22 is provided with bottom plate portions 29, each of which is formed, at its edge portion, with a recess 30. The recesses 30 are so configured as to be wider toward the side plate portion 23 and adapted for engagement with the skirt portions 19*a* and 19*b* provided at the lower portions of the drum 17, respectively. Through the foregoing engagement means, the frames 11*a* and 11*b* are attached to the bobbin 10.

A plurality of notches 27 are formed in the upper edge portion of each of the side plate portions 23. Further, a plurality of guide grooves 28 are defined by a plurality of protuberances provided at the lower end portion of the outer surface of each of the side plate portions 23. The notches 27 and guide grooves 28 are disposed in alignment with each other, and permit the lead wires 14 of the coil 13 to be led out downwardly, as will be described hereinafter.

Each of the outer plates 12*a* and 12*b* has an inverted L-shaped configuration including a horizontal portion 31 provided at the upper edge thereof. The outer plates 12*a* and 12*b* are arranged to be fitted from above in such a manner as to cover the lead wire leading-out regions 25 of the frames 11*a* and 11*b*. When fitted in this way, the outer plates 12*a* and 12*b* are retained in position with the horizontal portions 31 thereof resting on the upper edges of the side plate portions 23. To prevent removal of the outer plates 12*a* and 12*b* from the frames 11*a* and 11*b*, inwardly bent portions 32 are provided at the vertical outer edges of the side plate portions 24, 24 so that the outer plates 12*a* and 12*b*, when attached as mentioned above, are disposed in engagement therewith respectively. The outer plates 12*a* and 12*b* serve to prevent the lead wires 14 of the coil 13 from being displaced out of the guide grooves 28.

The coil 13 consists of a band-like conductor wound on the drum portion 17 of the bobbin 10 as mentioned above. The lead wires 14 are upwardly led out of the upper face of the coil 13.

The E-shaped core 15 comprises a center leg portion 33; a pair of side leg portions 34, 34; and a horizontal portion 35 connecting the center and side leg portions 33, 34, 34 together at the upper ends thereof. The E-shaped core 15 is disposed in engagement with the bobbin 10 in such a manner that the center leg portion 33 is inserted through the drum portion 17 of the bobbin 10; the side leg portions 34, 34 extend along the outer circumferential surface of the coil 13; and the horizontal portion 35 are interposed between the pair of arm-like portions 18*a* and 18*b* of the bobbin 10. The I-shaped core 16 is placed in contact with the lower end surfaces of the legs 33, 34, 34 of the E-shaped core 15 and securely attached thereto by using an adhesive agent or the like.

To construct the miniaturized transformer of the present invention, the above-mentioned components are assembled in such a manner as shown in FIGS. 3 and 4 wherein the E-shaped core 15, I-shaped core 16, and outer plates 12*a* and 12*b* are not shown for the convenience of illustration.

To securely attach the frame 11*a* to the bobbin 10, the end portions 20 of the arm-like portion 18*a* of the bobbin 10 are disposed in engagement with the slits 26 of the frame 11*a*, and then the skirt portion 19*a* of the frame 11*a* is fitted in the recess 30 formed in the bottom plate portion 29 of the frame 11*a*. The other frame 11*b* is also securely attached to the bobbin 10 in a similar manner.

The lead wires 14 led out of the upper end face of the coil 13 accommodated in the regions 22 of the frames 11*a* and 11*b*, are made to extend, through the notches 27 formed in the side plate portions 23 of the frames 11*a* and 11*b*, into the the lead-wire leading-out regions 25 and further extend downwardly beyond the lower edges of the side plate portions 23. The lead wires 14 are adapted to serve as terminals. To fix the lead wires 14 at the positions where they are led out, these lead wires 14 are fitted in the guide grooves 28 provided on the side plate portions 23. In this case, the outer plates 12*a* and 12*b* serve to prevent removal of the lead wires 14 from the guide grooves 28.

Although, in the foregoing embodiment, the coil 13 was formed of a band-like conductor, it is also possible that the coil may be formed of an ordinary wire-like material. Furthermore, although, in the foregoing embodiment, the drum portion 17 of the bobbin 10 was rectangular or square in cross-section, the drum portion 17 may be of a cylindrical shape having a circular cross-section. Depending on the quantity of the coil 13 wound on the drum portion 17, the spacing between the side plate portions 24, 24, the position of the side plate portions 23 relative to the side plate portions 24, 24, and the distance between the end portions 20 of the arm-like portions 18*a*, 18*b*, can be changed so that the volume of the coil accommodating regions 22 of the frames 11*a*, 11*b* can be changed. Although the frames 11*a* and 11*b* are configured such that their top portions are open and their bottom portions are also open except for the bottom plate portions 29, this is simply for the purpose of filling the interior of the frames 11*a* and 11*b* with a molten plastic material through the open portions thereof and causing the plastic material to be solidified therein to increase the entire fixing strength of the miniaturized transformer of the present invention as assembled as mentioned above. It is to be understood, however, that the present invention is by no means limited to the above-mentioned configuration of the frames 11*a* and 11*b*. Furthermore, by securely attaching the lead wires 14 in the regions 25 to the side plate portions 23 with an adhesive agent or the like, it may be possible to eliminate the notches 27, guide grooves 28 and outer plates 12*a*, 12*b*. However, the construction of the illustrated embodiment is preferred in that it has better external appearance and is easier to assemble. In the embodiment shown in FIGS. 2 to 4, the end portions 20 of the arm-like portions 18*a*, 18*b* of the bobbin 10 were bent in crank-like shape to facilitate engagement of the end portions 20 with the frames 11*a* and 11*b*. However, those end portions may be straight instead of being bent.

Further, it is also possible that arm-like portions similar to 18*a* and 18*b* may be provided at the bottom of the bobbin 10 and such arm-like portions may be disposed in engagement with the side plate portions 24, 24 respectively. In such a case, the bottom plate portions 29 will be eliminated.

Figure 5:
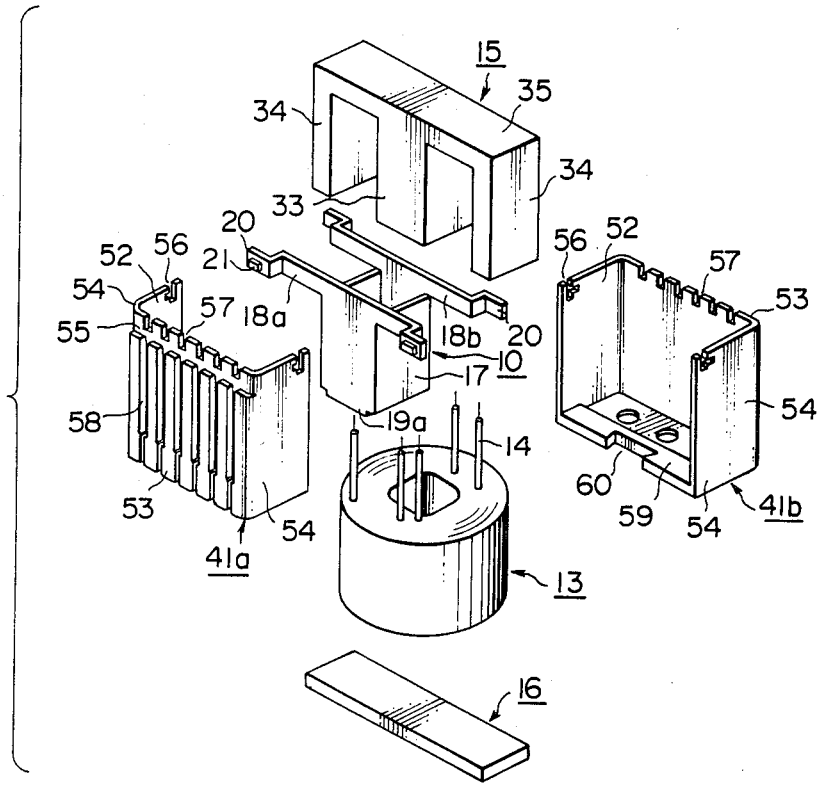
FIG. 5 is an exploded perspective view of the transformer according to another embodiment of the present invention.
Figure 6:
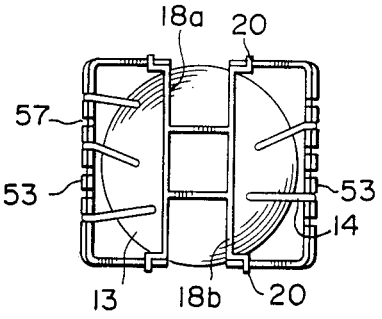
FIG. 6 is a top plan view showing the transformer of FIG. 5, with the cores thereof being omitted.
Figure 7:
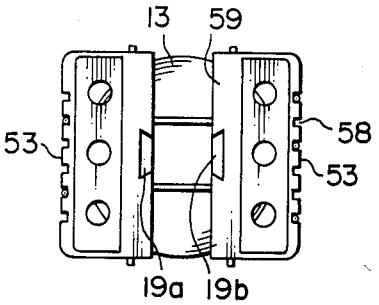
FIG. 7 is a bottom plan view showing the transformer of FIG. 5, with the cores thereof being omitted.

Referring to FIGS. 5 to 7, there is illustrated the transformer according to a second embodiment of the present invention. FIG. 5 is an exploded perspective view of the transformer; FIG. 6 is a top plan view thereof; and FIG. 7 is a bottom plan view thereof.

The second embodiment of the present invention shown in FIGS. 5 to 7 is similar to the foregoing first embodiment except that frames 41a and 41b are employed in place of the frames 11*a* and 11*b* and the outer plates 12*a* and 12*b* are eliminated. Thus, parts of the second embodiment corresponding to those of the first embodiment are indicated by like reference numerals, and further description thereof will be omitted.

In this embodiment, too, the frames 41*a* and 41*b* of this embodiment are of substantially the same height as the bobbin 10. Each of the frames 41*a* and 41*b* comprises a pair of opposing side plate portions 54, 54, and a third side plate portion 53 disposed substantially at right angles with respect to the side plate portions 54, 54 and connecting the latter together; thus, as viewed in a plan view, each of the frames 41*a* and 41*b* takes a U-shaped form. The side plate portions 54, 54 are connected together at their bottom ends through bottom plate portions 59. Regions 52 for accommodating the coil 13 therein are defined by the side plate portions 53, 54, 54 and bottom plate portions 59. At the external surface of each of the side plate portions 53, there is provided a surface portion 55 along which the lead wires 14 of the coil 13 are led out. In the upper corners of the side plate portions 54, 54, vertically extending slits 56 are formed which are adapted to be engaged with the end portions 20 of the arm-like portions 18 and 18*b* of the bobbin 10 respectively. Each of the slits 56 is provided with a wider portion. Protuberances 21 are provided at the end portions 20 of the arm-like portions 18*a* and 18*b*, and adapted to be disposed in engagement with the aforementioned wider portions of the slits 56 respectively when the end portions 20 of the arm-like portions 18*a* and 18*b* are fitted in the slits 56 respectively, thereby ensuring that the end portions 20 of the arm-like portions 18*a* and 18*b* are retained in the slits 56. Each of the bottom plate portions 59 has a recess 60 formed in the edge portion thereof, and each of the recesses 60 are configured to be wider toward the side plate portion 53. The recesses 60 are adapted to be engaged with skirt portions 19*a* and 19*b* of the bobbin 10. A plurality of downwardly extending notches 57 are formed in the upper edge portion of each of the side plate portions 53. Further, a plurality of guide grooves 58 are provided on the lead-wire leading-out surface portions 55. The notches 57 and guide grooves 58 are disposed in alignment with each other and serve to permit the lead wires 14 of the coil 13 to be downwardly led out.

To construct the miniaturized transformer according to the second embodiment, the above-mentioned components are assembled as shown in FIGS. 6 and 7 wherein the E-shaped core 15, I-shaped core 16 and outer plates 12*a* and 12*b* are not shown for the convenience of illustration.

Figure 8:
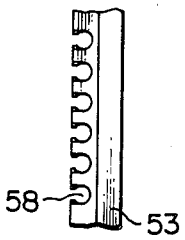
FIG. 8 is an enlarged fragmentary bottom plan view showing the side plate portion of the frames of the transformer shown in FIG. 7.

To securely attach the frame 11*a* to the bobbin 10, the end portions 20 of the arm-like portion 18*a* of the bobbin 10 are placed in engagement with the slits 56 of the frame 41*a*, and then the skirt portion 19*a* of the bobbin 10 is fitted in the recess 60 formed in the bottom plate 59 of the frame 41*a*. The other frame 41*b* can also be securely attached to the bobbin 10 in a similar manner. The coil 13 is accommodated in the regions 52 of the frames 41*a* and 41*b*, and the lead wires 14 are upwardly led out of the upper end face of the coil 13. The lead wires 14 thus led out are then made to extend, through the notches 57 formed in the side plate portions 53 of the frames 41*a* and 41*b*, as far as the external surface portions 55 and further extend, through the guide grooves 58, downwardly beyond the lower edges of the frames 41*a* and 41*b*. The lead wires 14 are used as terminals. By making the lower portions of the guide grooves 58 narrower as shown in FIG. 5, it is possible to prevent removal of the lead wires 14 from the guide grooves 58. FIG. 8 is an enlarged fragmentary bottom view showing the lower portion of each side plate portion 53, wherein the opening portion of each groove 58 is made to be smaller than the width of the lead wires 14 so that the latters can be securely fitted in the grooves 58. In the upper portion of each side plate portion 53, the width of opening portion of each groove 58 is made to be equal to or greater than the width of each lead wire 14. It is to be understood, however, that the present invention is by no means limited to the aforementioned configuration of the guide grooves 58 but it is only required that means be provided for securely retaining the lead wires in at least the lower portions of the guide grooves 58.

It will be appreciated that the aforementioned second embodiment of the present invention is advantageous over the first embodiment in that the third side plate portions serving as separator plates and outer plates are not needed so that the number of parts can be reduced and the time required for assembling the components can be shortened.

Figure 1:
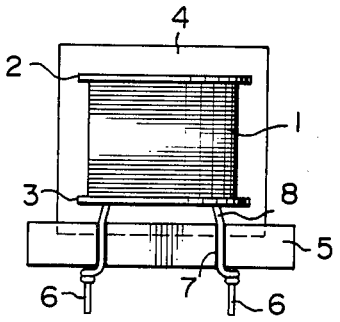
FIG. 1 PRIOR ART
FIG. 1 is a side view of a conventional transformer.

As explained above, with the construction of the miniaturized transformer according to the present invention, the lead wires of the coil are first upwardly led out of the upper end face of the coil, subsequently bent outwardly and then extended downwardly so as to be used as terminals; and the bobbin is fixed by the pair of frames which have substantially the same height as the bobbin so that the positions where the lead wires are led out of the frames become substantially flush with the lower end of the drum portion on which the coil is wound. As will be appreciated from the above explanation, the transformer of the present invention is simplified over the conventional transformer shown in FIG. 1 in that no base plate is provided under the bobbin and the lead wires are directly led out to the positions of terminal pins. Such simplification results in the transformer of the present invention having a decreased height as compared with the conventional one. A further advantage of the present invention over the prior art is such that the trouble of connecting lead wires to terminal pins is eliminated by the fact that the lead wires are as terminals, so that assembling operation is facilitated.

While the present invention has been described and illustrated with respect to specific embodiments thereof, it is to be understood that the present invention is by no means limited thereto but covers all changes and modifications which will become possible within the scope of the appended claims.

We claim:

1. A miniaturized transformer, comprising:

a bobbin provided with a drum portion on which a coil is wound; and a pair of frames which are securely attached, from opposite sides, to said bobbin for accommodating said coil therein;

said bobbin including a pair of arm-like portions, each of said arm-like portions having first engagement means provided at each end portion thereof, said first engagement means being adapted to be disposed in engagement with second engagement means of said frames;

each of said pair of frames comprising a first and a second side plate portion which are disposed in opposing relationship with each other, and a third side plate portion disposed substantially at right angles with respect to said first and second side plate portions and connecting said first and second side plate portions together, each of said first and second side plate portions being provided with said second engagement means adapted for engagement with said first engagement means provided at each end portion of said arm-like portions of said bobbin;

wherein lead wires of the coil which are upwardly led out of said coil, are made to downwardly extend along the outer surfaces of said third side plate portions so as to be used as terminals.

2. A miniaturized transformer according to claim 1, wherein each of said pair of frames further includes a bottom plate portion provided at the lower end of said first and second side plate portions and connecting said first and second side plate portions together, each of said bottom plate portions being provided with recesses adapted for engagement with said drum portion of said bobbin.

3. A miniaturized transformer according to claim 1, wherein each of said third side plate portions includes notches formed in the upper end portion thereof for permitting the lead wires of the coil to be extended therethrough, and guide grooves provided on the outer surface thereof and guiding and securely retaining the lead wires of the coil, and wherein the lead wires are led out downwardly passing through said recesses and said guide grooves in the named order.

4. A miniaturized transformer according to claim 1, wherein for each of said frames, said third side plate portion is coupled to said first and second side plate portions at those ends thereof which are remote from said bobbin, so that said each frame is configured to have a substantially U-shaped cross-section.

5. A miniaturized transformer according to claim 1, wherein for each of said frames, said third side plate portion is coupled to said first and second side plate portions at a position which is slightly deviated toward said bobbin from those ends of said first and second side plate portions which are remote from said bobbin, so that said each frame is configured to have a modified H-shaped cross-section.

6. A miniaturized transformer according to claim 5, wherein each of said third side plate portions is arranged to serve as a separator plate for separating a coil accommodating region and lead-wire leading-out region which are at the opposite sides of said each third side plate portion.

7. A miniaturized transformer according to claim 6, wherein each of said third side plate portions includes notches formed in the upper end portion thereof for permitting the lead wires of the coil to be extended therethrough, and guide grooves provided on the outer surface thereof for guiding and securely retaining said lead wires, and wherein said lead wires are downwardly led out passing through said notches and said guide grooves, and wherein outer plates are provided on the respective frames for preventing removal of said lead wires from said guide grooves.

8. A miniaturized transformer according to claim 3, wherein for each of said guide grooves, the opening width thereof is partially made to be smaller than the width of the interior portion thereof.

9. A miniaturized transformer according to claim 1, wherein said pair of arm-like portions are provided at least at the upper end of said drum portion in such a manner as to extend horizontally and in parallel with each other.

* * * * *